US006584626B1

(12) United States Patent
DiRoma

(10) Patent No.: US 6,584,626 B1
(45) Date of Patent: Jul. 1, 2003

(54) PATIENT TRANSFER DEVICE

(76) Inventor: Alex DiRoma, 8362 Amigo Ave. #7, Northridge, CA (US) 91324

( * ) Notice: Subject to any disclaimer, the term of this patent is extended or adjusted under 35 U.S.C. 154(b) by 0 days.

(21) Appl. No.: 10/179,835

(22) Filed: Jun. 24, 2002

(51) Int. Cl.[7] ..... A61G 7/08
(52) U.S. Cl. ..... 5/81.1 HS; 5/81.1 R; 193/35 R
(58) Field of Search ..... 5/81.1 R, 81.1 HS, 5/81.1 RP; 414/921; 193/35 R, 35 A

(56) References Cited

U.S. PATENT DOCUMENTS 3,962,736 A * 6/1976 Fedele ..... 5/81.1 HS
4,259,756 A * 4/1981 Pace ..... 5/81.1 HS
4,644,594 A * 2/1987 Johnson ..... 5/81.1 HS
5,152,016 A * 10/1992 Becker ..... 5/81.1 HS
5,193,233 A * 3/1993 Miller ..... 5/81.1 R
6,484,332 B2 * 11/2002 Korver et al. ..... 5/18.1 R

* cited by examiner

*Primary Examiner*—Michael F. Trettel
(74) *Attorney, Agent, or Firm*—Goldstein & Lavas, P.C.

(57) ABSTRACT

A patient transfer device for aiding in the comfortable and easy transfer of incapacitated persons from a bed to a gurney, or vice versa. The transfer device has a stationary board having a number of roller assemblies, and a movable board having a number of channels for accommodating the roller assemblies. When the movable board is mounted on top of the stationary board, the roller assemblies allow the movable board to slide thereover. Each roller assembly has a column of balls secured within a track. Dividers extend horizontally between the side walls, adjacent to the balls, to prevent the balls from sliding within the track. The movable board channels are interlocked with the tracks. This configuration prevents the movable board from lifting upward, off of the stationary board while in use.

1 Claim, 4 Drawing Sheets

10

PATIENT TRANSFER DEVICE

BACKGROUND OF THE INVENTION

The invention relates to a patient transfer device. In particular, the invention is a transfer device having a stationary board and a movable board, wherein a patient is placed on the movable board for transfer from one location to another.

When moving a patient, much care has to be taken not to injure or cause unnecessary discomfort to the person. Typically, the patient is moved from his or her bed to a gurney, by which he or she is transported to another bed or to a table. This can often be a difficult task since at least two people are necessary to lift and move the patient.

Thus, there exists a need for a patient transfer board that allows a caregiver to move a person from one location to another, namely from a bed to a gurney or from a gurney to a bed or table. Such a device should allow the patient to be easily moved without any discomfort and with a minimal amount of help.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved patient transfer device. As such, the general purpose of the present invention, which will be described subsequently in greater detail, is to provide a new and improved patient transfer device which has all the advantages of the prior art and none of the disadvantages.

To attain this, the present invention essentially comprises a patient transfer device for aiding in the comfortable and easy transfer of incapacitated persons from a bed to a gurney, or vice versa. The transfer device has a stationary board having a number of roller assemblies, and a movable board having a number of channels for accommodating the roller assemblies. When the movable board is mounted on top of the stationary board, the roller assemblies allow the movable board to slide thereover. Each roller assembly has a column of balls secured within a track. Dividers extend horizontally between the side walls, adjacent to the balls, to prevent the balls from sliding within the track. The movable board channels are interlocked with the tracks. This configuration prevents the movable board from lifting upward, off of the stationary board while in use.

It is an object of the invention to produce a patient transfer device that allows for easy movement of the patient from a bed to a gurney or vice versa. Accordingly, the transfer device has a stationary board and a movable board. The stationary board to situated adjacent to the patient, with the movable board directly thereabove. After the patient is placed on the movable board, said board is then slid past the stationary board.

It is a further object of the invention to produce a patient transfer device that enables a patient to be moved by a minimal number of caregivers. Accordingly, once the patient is placed on the movable board, said board glides over the stationary board with little effort.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
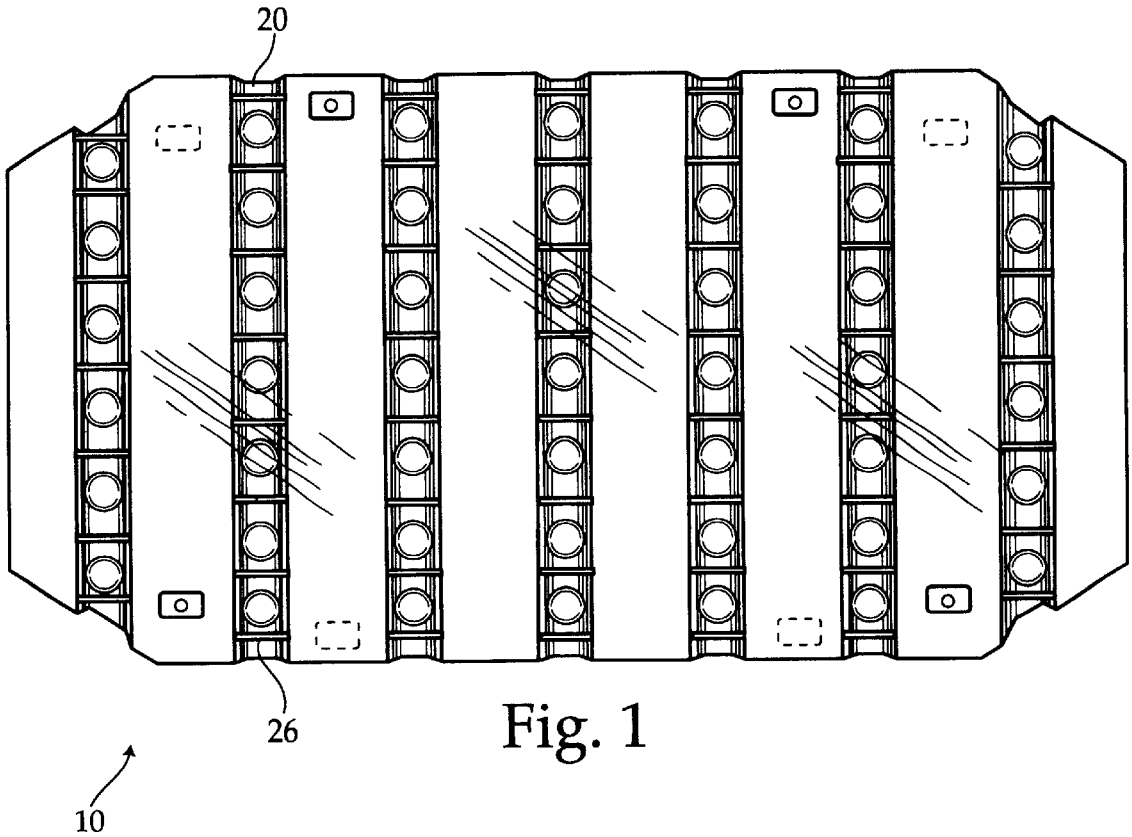
FIG. 1 is a top plan view of the patient transfer device.
Figure 2:
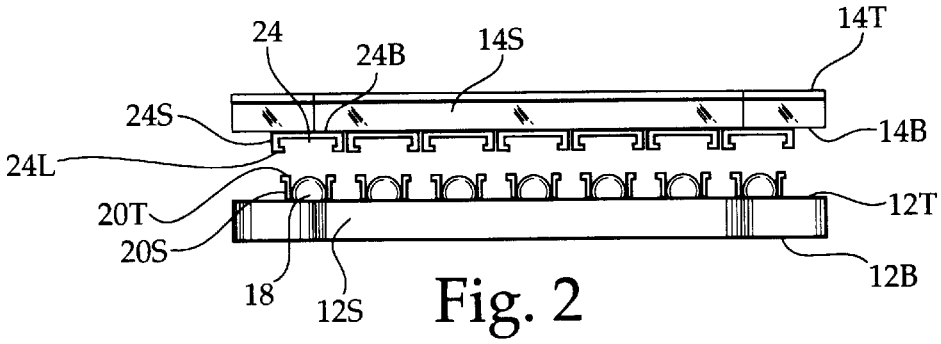
FIG. 2 is a side elevational view thereof.

| REFERENCE NUMERALS | |
|---|---|
| 10 | patient transfer device |
| 12 | stationary board |
| 12B | bottom surface of stationary board |
| 12T | top surface of stationary board |
| 12S | side edge of stationary board |
| 14 | movable board |
| 14T | top surface of movable board |
| 14B | bottom surface of movable board |
| 14S | side edge of movable board |
| 16 | roller assembly |
| 18 | ball |
| 20 | track |
| 20S | track side wall |
| 20T | track side wall top ledge |
| 24 | movable board channels |
| 24S | side wall of channel |
| 24B | bottom surface of channel |
| 24L | top lip of channel |
| 26 | divider |
| 28 | movable board stopper |
| 30 | stationary board stopper |

DETAILED DESCRIPTION OF THE PREFERRED EMBODIMENTS

FIG. 1 illustrates a patient transfer device 10 primarily utilized in the comfortable and easy transfer of incapacitated persons from a bed to a gurney, or vice versa. The transfer device 10 essentially comprises a stationary board 12 having a plurality of roller assemblies 16 disposed thereon, and a movable board 14 having a plurality of channels 24 for accommodating the roller assemblies 16, wherein the stationary board 12 is positioned below the movable board 14.

The stationary board 12 has a bottom surface 12B, a top surface 12T, and a pair of side edges 12S, wherein the roller assemblies 16 are situated on the top surface 12T extending between the side edges 12S. The stationary board 12 has a plurality of roller assemblies 16, said roller assemblies arranged in parallel columns along the length of said stationary board 12. When the movable board 14 is mounted on top of the stationary board 12, the roller assemblies 16 allow said movable board 14 to slide thereover. Each roller assembly 16 comprises a column of balls 18 secured within a track 20. Each track 20 has two side walls 20S, between which the balls 18 are contained, said side walls 20S each having a top ledge 20T. The top ledges 20T are oriented away from the balls 18, to a point past the side wall 20S, and serve to engage the movable board channels 24, as will be described hereinafter. Dividers 26 are spaced evenly along each of the movable board channels 24 and extend horizontally between the side walls 20S, adjacent to the balls 18. The dividers 26 are positioned between each ball 18 in order to prevent the balls 18 from sliding within the track 20S and thus keep the balls 18 generally distributed along the length of the track 20. The balls 18, when in place within the tracks 20, extend above the top ledges 20T.

The movable board 14 is substantially the same shape and size as the stationary board 12, thereby allowing the movable board 14 to fit over the stationary board 12 when in the closed position. The movable board 14 comprises a top surface 14T, a bottom surface 14B, and a pair of side edges 14S. The channels 24 extend vertically between the side edges 14S on the bottom surface 14B of said board 14. The channels 24 comprise a bottom surface 24B, a pair of side walls 24S and a top lip 24L that extends inward from the side walls 24S.

When the movable board 14 is mounted on top of the stationary board 12, the movable board bottom surface 14B is substantially parallel to the stationary board top surface 12T. The channels 24 are slidably interlocked with the tracks 20. In particular, the channel top lips 24L engage the track top ledges 20T, thereby securing the movable board 14 in place on the stationary board 12. This configuration prevents the movable board 14 from lifting upward, off of the stationary board 12 while in use, but allows longitudinal movement. Further, the ball 18 comes into direct contact with the bottom surface 24B of the channel 24, thereby enabling the movable board 14 to glide smoothly over the stationary board 12.

Figure 3:
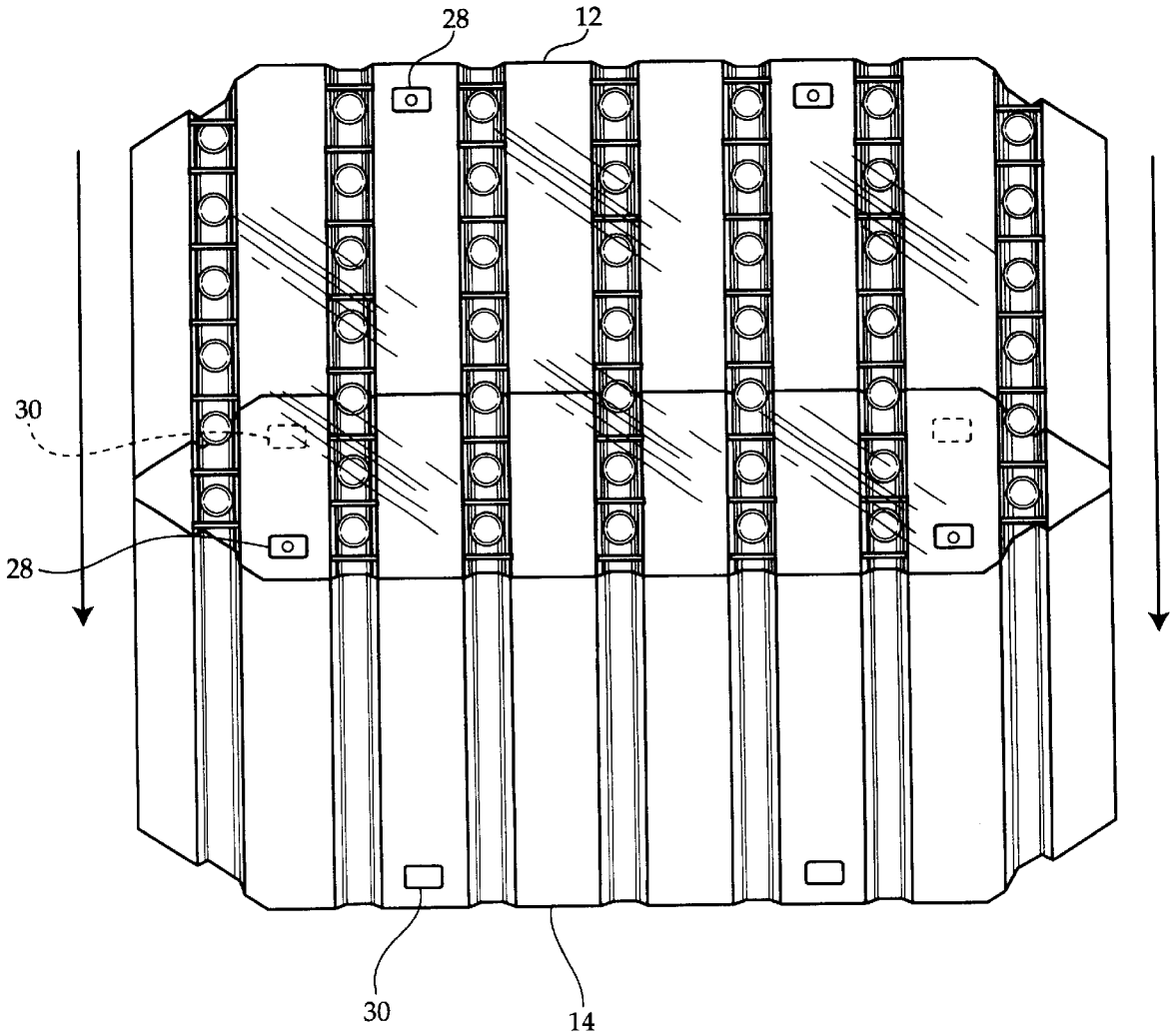
FIG. 3 is a top plan view of the patient transfer device, illustrating movement of the movable board.
Figure 4:
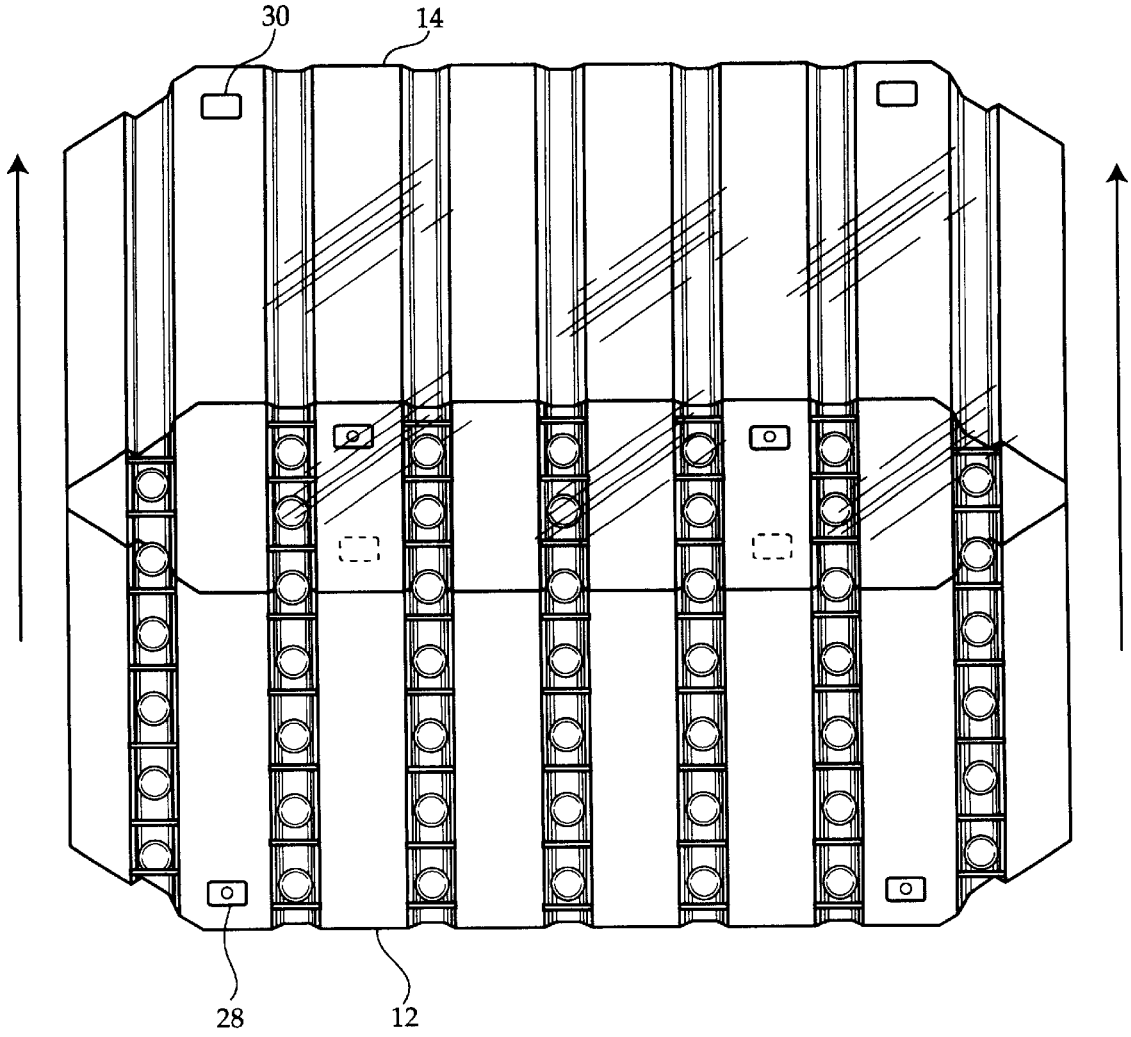
FIG. 4 is a top plan view of the patient transfer device, illustrating movement of the movable board in the opposite direction then shown in FIG. 3.
Figure 5:
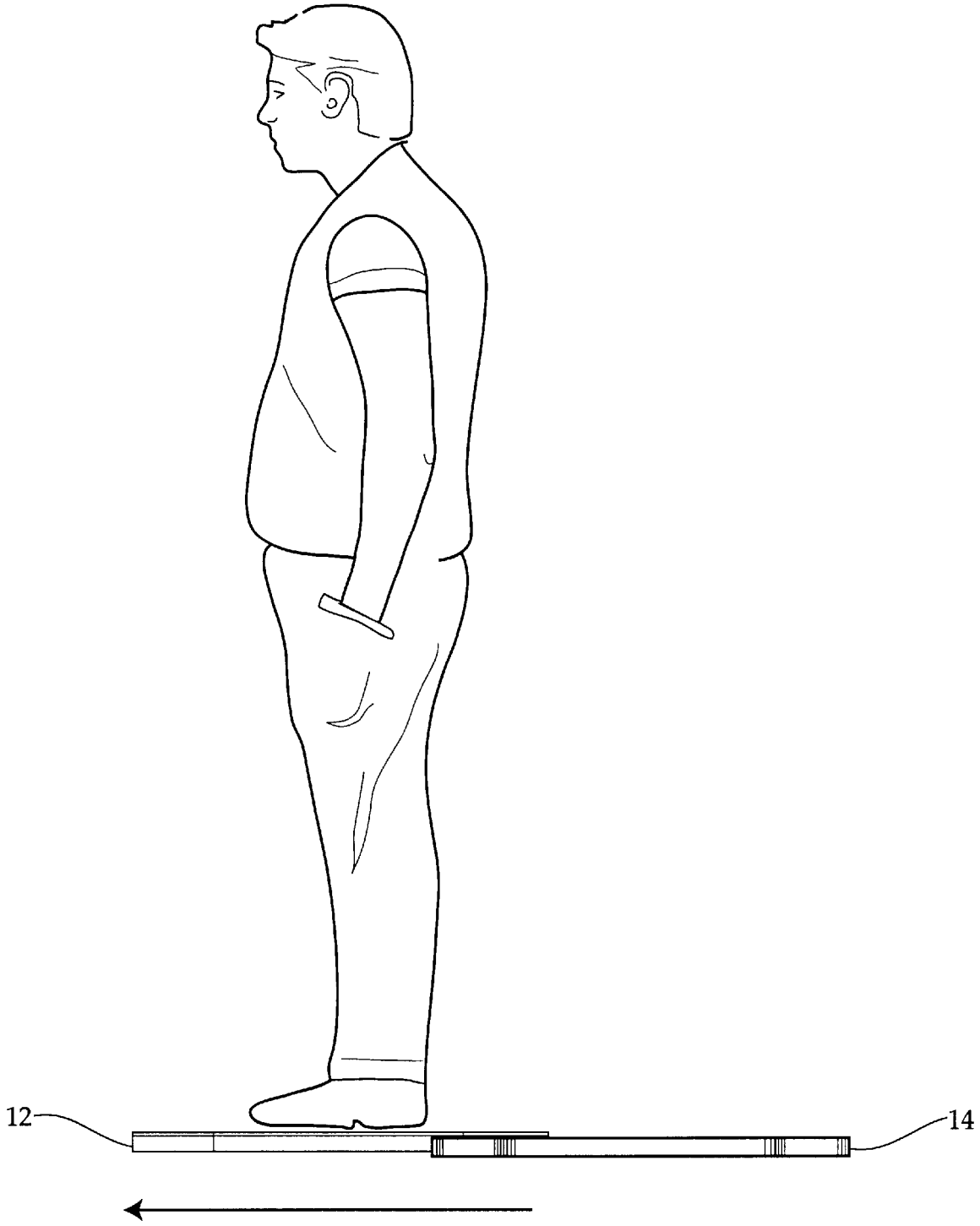
FIG. 5 is a side elevational view of the patient transfer device in use.

Stoppers, namely movable board stoppers 28 and stationary board stoppers 30, are secured to the boards 12, 14 in order to prevent the movable board 14 from separating from the stationary board 12. The movable board stoppers 30 are situated on the bottom surface 14B of the movable board 14, extending downward between the channels 24. The stationary board stoppers 20 are positioned on the top surface 12T of the stationary board 12, extending upward between the tracks 20. The stoppers 28, 30 are in corresponding positions on both boards 12, 14, in order to allow the stoppers 28, 30 to come into contact when the movable board 14 is slid over the stationary board 12, as illustrated in FIGS. 3 and 4. Thus, when the movable board 14 is slid over the stationary board 12, the movable board stoppers 28 will come into contact with the stationary board stoppers 30 and prevent further movement.

In use, the movable board 14 is positioned directly on top of the stationary board 12. A patient is then placed on the top surface 14T of the movable board 14 for transport. The movable board 14 is then slid over the stationary board 12, with the stationary board remaining still, until the desired movement is achieved or until the movable board stoppers 28 come into contact with the stationary board stoppers 30.

In conclusion, herein is presented a patient transport device. The invention is illustrated by example in the drawing figures, and throughout the written description. It should be understood that numerous variations are possible, while adhering to the inventive concept. Such variations are contemplated as being a part of the present invention.

What is claimed is:

1. A patient transport assembly, comprising:

a stationary board, the stationary board having a bottom surface, a top surface, two side edges, and a plurality of roller assemblies extending between the side edges on the top surface, each roller assembly having a track and a plurality of balls contained within the track, each track having two side walls, the walls containing the balls and each wall having a top ledge oriented away from the balls, the roller assemblies further comprising dividers, the dividers extending horizontally between the side walls, said dividers positioned between each ball to prevent the balls from sliding within the track;

a movable board, the movable board having a bottom surface, a top surface, and two side edges, wherein the movable board is positioned on top of the stationary board with the movable board bottom surface adjacent to the stationary board top surface, said movable board further having a plurality of channels extending vertically between the side edges on the bottom surface, said channels mateable with the stationary board tracks and having a bottom surface, a pair of side walls, and a top lip that extends inward from the side walls, wherein the top lip is mated with the top ledge of the stationery board tracks, thereby interlocking the moveable board with the stationary board, the interlocking prevents upward separation of the boards, and wherein when the movable board is mounted on top of the stationary board, the roller assemblies allow said movable board to slide smoothly thereover; and a plurality of stoppers, the stoppers comprising movable board stoppers and stationary board stoppers, wherein the movable board stoppers are positioned on the bottom surface thereof between the channels, and the stationary board stoppers are positioned on the top surface thereof between the tracks, said stoppers being in corresponding positions on the boards, wherein when the movable board slides over the stationary board, the movable board stoppers come into contact with the stationary board stoppers and prevent separation of the boards.

* * * * *